US009257099B2

(12) United States Patent
Koo et al.

(10) Patent No.: US 9,257,099 B2
(45) Date of Patent: Feb. 9, 2016

(54) VOLTAGE GENERATOR AND DISPLAY DEVICE HAVING THE SAME

(71) Applicant: Samsung Display Co., Ltd., Yongin (KR)

(72) Inventors: Bon-Sung Koo, Seongnam-si (KR); Jong Jae Lee, Asan-si (KR); Eui-Dong Hwang, Bucheon-si (KR)

(73) Assignee: Samsung Display Co., Ltd., Yongin (KR)

( * ) Notice: Subject to any disclaimer, the term of this patent is extended or adjusted under 35 U.S.C. 154(b) by 299 days.

(21) Appl. No.: 13/732,747

(22) Filed: Jan. 2, 2013

(65) Prior Publication Data

US 2014/0049528 A1 Feb. 20, 2014

(30) Foreign Application Priority Data

Aug. 14, 2012 (KR) ..... 10-2012-0089067

(51) Int. Cl.

| | |
|---|---|
| ***G09G 3/36*** | (2006.01) |
| ***G09G 5/20*** | (2006.01) |
| ***G05F 3/02*** | (2006.01) |
| ***G05F 1/10*** | (2006.01) |

(52) U.S. Cl.

CPC .. *G09G 5/20* (2013.01); *G05F 1/10* (2013.01); *G05F 3/02* (2013.01); *G09G 3/3696* (2013.01); *G09G 2310/08* (2013.01); *G09G 2330/025* (2013.01)

(58) Field of Classification Search

CPC ..... G05F 1/10; G05F 3/02; G09G 3/3696; G09G 5/20; G09G 2310/08; G09G 2330/025

USPC ..... 345/87–104, 211

See application file for complete search history.

(56) References Cited

U.S. PATENT DOCUMENTS

| | | | | |
|---|---|---|---|---|
| 7,362,291 | B2 | 4/2008 | Park | |
| 8,730,146 | B2 * | 5/2014 | Lee | 345/101 |
| 2010/0033415 | A1 * | 2/2010 | Bae et al. | 345/94 |
| 2010/0246686 | A1 | 9/2010 | Pezeshk et al. | |
| 2011/0227502 | A1 | 9/2011 | Kim et al. | |
| 2012/0112712 | A1 | 5/2012 | Kim et al. | |
| 2012/0120342 | A1 | 5/2012 | Uchimoto et al. | |
| 2012/0313682 | A1 * | 12/2012 | Sprentall et al. | 327/172 |

FOREIGN PATENT DOCUMENTS

| | | |
|---|---|---|
| KR | 10-2000-0041545 | 7/2000 |
| KR | 10-2001-0065766 | 7/2001 |
| KR | 10-2004-0043060 | 5/2004 |
| KR | 10-2008-0042355 | 5/2008 |
| KR | 10-2008-0099417 | 11/2008 |
| KR | 10-2012-0018660 | 3/2012 |

* cited by examiner

*Primary Examiner* — Kent Chang
*Assistant Examiner* — Nelson Rosario
(74) *Attorney, Agent, or Firm* — H.C. Park & Associates, PLC

(57) ABSTRACT

A display device including a voltage generator is disclosed. The voltage generator includes an analog driving voltage generator to convert a source voltage from an external source to an analog driving voltage and to output the analog driving voltage through an output terminal, a capacitor connected between the output terminal and a ground voltage node, and a discharge circuit connected between the output terminal and the ground voltage node to discharge a current at the output terminal in response to a blank synchronization signal.

18 Claims, 9 Drawing Sheets

VOLTAGE GENERATOR AND DISPLAY DEVICE HAVING THE SAME

CROSS REFERENCE TO RELATED APPLICATION

This application claims priority from and the benefit of Korean Patent Application No. 10-2012-0089067, filed on Aug. 14, 2012, which is hereby incorporated by reference for all purposes as if fully set forth herein.

BACKGROUND OF THE INVENTION

1. Field of the Invention

Exemplary embodiments of the present invention relate to a voltage generator and a display device including the voltage generator.

2. Discussion of the Background

A multi-layer ceramic capacitor (MLCC) is a condenser in a chip structure and used in various electronic devices, e.g., a display device, a mobile communication terminal, a notebook, a computer, a personal digital assistant, a smart phone, and a smart television, to charge or discharge electric charges. The MLCC may have various sizes and laminated structures depending on the MLCC's use and capacitance.

In general, the multi-layer ceramic capacitor may be configured to include a plurality of dielectric layers. Electrodes of different polarities are alternately inserted between the dielectric layers stacked one on another. The multi-layer ceramic capacitor is employed in various fields for use in electronic devices since the multi-layer ceramic capacitor has various advantages, e.g., small size, high capacitance, simple mounting.

The multi-layer ceramic capacitor may be formed of a ferroelectric material as a ceramic material, e.g., barium titanate. However, since the ferroelectric material has piezoelectricity and piezoresistivity, stress component and mechanical deformation appear in the ferroelectric material as vibrations when an electric field is applied to the ferroelectric material, and the vibrations are transferred to a substrate through terminal electrodes of the multi-layer ceramic capacitor. For example, when an alternating current voltage is applied to the multi-layer ceramic capacitor, the stress components Fx, Fy, and Fz occur along X, Y, and Z directions of the multi-layer ceramic capacitor, and the stress components cause the vibrations. The substrate, to which the vibrations are applied through the terminal electrodes, may act as a sound reflecting plate, and thus a vibration noise may be generated. Since the vibration noise has an audible frequency of about 20 Hz to about 20 KHz, a user of the display device may be irritated and inconvenienced.

The above information disclosed in this background section is only for enhancement of understanding of the background of the invention and therefore it may contain information that does not form any part of the prior art nor what the prior art may suggest to a person of ordinary skill in the art.

SUMMARY OF THE INVENTION

Exemplary embodiments of the present invention provide a voltage generator capable of reducing unwanted vibration noise.

Exemplary embodiments of the present invention also provide a display device including the voltage generator.

Additional features of the invention will be set forth in the description which follows, and in part will be apparent from the description, or may be learned by practice of the invention.

Exemplary embodiments of the invention disclose a voltage generator which includes an analog driving voltage generator configured to convert a source voltage to an analog driving voltage and to output the analog driving voltage via an output terminal. The invention further include a capacitor connected between the output terminal and a ground voltage, and a discharge circuit connected between the output terminal and the ground voltage configured to discharge a current at the output terminal in response to a blank synchronization signal.

Exemplary embodiments of the present invention also disclose a display device comprising a display panel including a plurality of pixels, a driving circuit configured to control the display panel to display an image and to provide a blank synchronization signal. The display device further includes a voltage generator configured to provide an analog driving voltage required to drive the driving circuit. The voltage generator includes an analog driving voltage generator configured to convert source voltage to an analog driving voltage and to output the analog driving voltage via an output terminal. A capacitor may be connected between the output terminal and a ground voltage. A discharge circuit is connected between the output terminal and the ground voltage, and is configured to discharge a current at the output terminal in response to the blank synchronization signal.

Exemplary embodiments of the invention also disclose a voltage generator which includes an analog driving voltage generator configured to convert a source voltage to an analog driving voltage and to output the analog driving voltage via an output terminal. The invention further includes a capacitor connected between the output terminal and a ground voltage, a ripple detector configured to receive the analog driving voltage output from the output terminal to detect a level of a ripple and to output a control voltage corresponding to the level of the ripple.

The voltage generator also includes a pulse width modulation circuit configured to output a pulse width modulation signal having a pulse width corresponding to the control voltage. The analog driving voltage output from the analog driving voltage generator includes a voltage level corresponding to the pulse width modulation signal.

Exemplary embodiments of the invention also disclose a display device which includes a display panel that includes a plurality of pixels, a driving circuit configured to control the display panel to display an image, and a voltage generator configured to output an analog driving voltage required to drive the driving circuit. The voltage generator includes an analog driving voltage generator configured to convert a source voltage to the analog driving voltage and to output the analog driving voltage via an output terminal, a capacitor connected between the output terminal and a ground voltage. The voltage generator further includes a ripple detector configured to receive the analog driving voltage output from the output terminal to detect a level of a ripple and to output a control voltage corresponding to the level of the ripple, and a pulse width modulation circuit configured to output a pulse width modulation signal having a pulse width corresponding to the control voltage. The analog driving voltage output from the analog driving voltage generator includes a voltage level corresponding to the pulse width modulation signal.

Exemplary embodiments of the invention also disclose a method of reducing noise in a display device. The method includes converting a source voltage to an analog driving voltage, charging a capacitor with the analog driving voltage, detecting a level of a ripple in the analog driving voltage to provide a control voltage corresponding to the level of the ripple, and generating a pulse width modulation signal corresponding to the control voltage. The analog driving voltage includes a voltage level corresponding to a voltage level of the pulse width modulation signal It is to be understood that both the foregoing general description and the following detailed description are exemplary and explanatory and are intended to provide further explanation of the invention as claimed

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
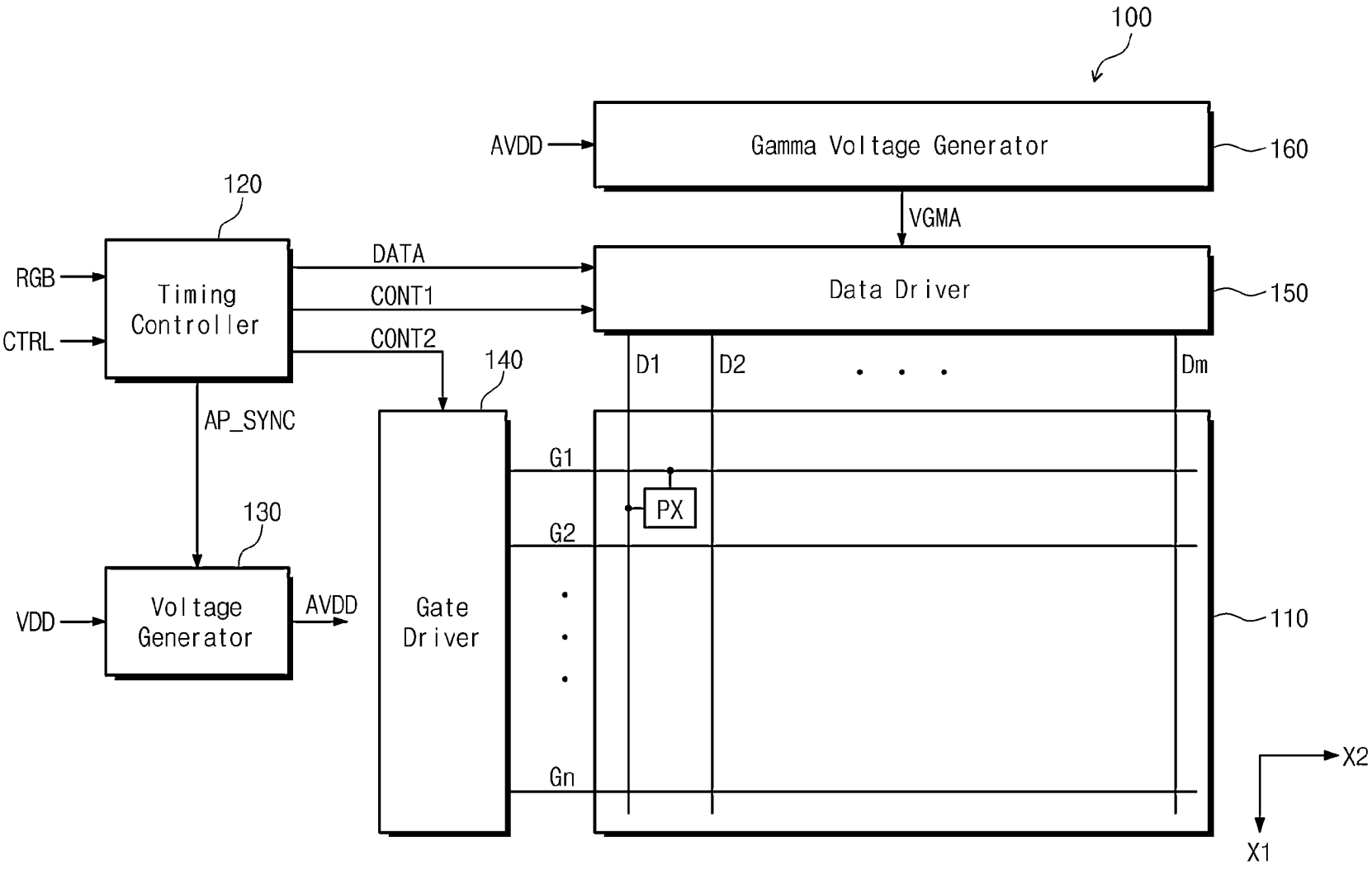
FIG. 1 illustrates a block diagram of a display device according to exemplary embodiments of the present invention.

The invention is described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough, and will fully convey the scope of the present invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof. It should be understood that for the purposes of this disclosure, "at least one of X, Y, and Z" can be construed as X only, Y only, Z only, or any combination of two or more items X, Y, and Z (e.g., XYZ, XYY, YZ, ZZ).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the present invention will be explained in detail with reference to the accompanying drawings.

FIG. 1 is a block diagram showing a display device according to exemplary embodiments of the present invention. The display device may be a liquid crystal display device, but is not limited to the liquid crystal display.

Referring to FIG. 1, a display device 100 may include a display panel 110, a timing controller 120, a voltage generator 130, a gate driver 140, a data driver 150, and a gamma voltage generator 160.

The display panel 110 may include a plurality of data lines D1 to Dm (m being any whole number greater than 1) extended in a first direction X1, a plurality of gate lines G1 to Gn (n being any whole number greater than 1) extended in a second direction X2 to cross the data lines D1 to Dm, and a plurality of pixels PX arranged in areas defined by the crossing of the data lines D1 to Dm and the gate lines G1 to Gn. The data lines D1 to Dm are insulated from the gate lines G1 to Gn. The gate lines G1 to Gn may extend in a direction corresponding to a row of pixels in the display panel 110, and the data lines D1 to Dm may extend in a direction corresponding to a column of pixels in the display panel 110. In some cases, the data driver 150 may be mounted directly on the display panel 100, may be connected to the display panel 110, or may be integrated on the display panel 110.

Although not illustrated in FIG. 1, each pixel PX may include a switching transistor connected to a corresponding data line of the data lines D1 to Dm and a corresponding gate line of the gate lines G1 to Gn, a liquid crystal capacitor connected to the switching transistor, and a storage capacitor connected to the switching transistor.

The timing controller 120, the gate driver 140, the data driver 150, and the gamma voltage generator 160 may serve as driving circuits that may allow an image to be displayed on the display panel 110.

The timing controller 120 may receive an image signal RGB and a control signal CTRL used to control other signals, e.g., a vertical synchronization signal Vsync, a horizontal synchronization signal Hsync, a main clock signal MCLK, and a data enable signal DE. The timing controller 120 may process the image signal RGB according to the control signal CTRL to generate image data signal DATA, may apply the image data signal DATA and a first control signal CONT1 to the data driver 150, and may apply a second control signal CONT2 to the gate driver 140. The first control signal CONT1 includes a first start pulse signal STH, a clock signal CLK, a polarity inversion signal POL, and a line latch signal LOAD, and the second control signal CONT2 includes a vertical synchronization start signal STV, an output enable signal OE, and a gate pulse signal CPV.

The voltage generator 130 may receive a source voltage VDD from an external source (not shown) and may convert the source voltage VDD to an analog driving voltage AVDD. The voltage generator 130 may also generate a common voltage VCOM required to drive the display panel 110, and gate on and off voltages VON and VOFF required to drive the gate driver 140. The voltage generator may also receive a blank synchronization signal AP_SYNC from the timing controller 120.

The gate driver 140 may drive the gate lines G1 to Gn in response to the second control signal CONT2 from the timing controller 120. The gate driver 140 may include a gate driver IC. The gate driver 140 may be made of an oxide semiconductor, an amorphous semiconductor, a crystalline semiconductor, or a polycrystalline semiconductor.

The gamma voltage generator 160 may receive the analog driving voltage AVDD generated by the voltage generator 130 and may generate gamma voltages VGMA according to the analog driving voltage AVDD. The gamma voltage generator 160 may provide the gamma reference voltage VGMA to the data driver 150 configured to drive data lines D1 . . . Dm.

The data driver 150 may be controlled by the image data signal DATA and the first control signal CONT1 from the timing controller 120, and may output gray scale voltages by using the gamma voltages VGMA to drive the data lines D1 to Dm.

When the gate on voltage VON is applied to the corresponding gate line by the gate driver 140, switching transistors arranged in one row and connected to the corresponding gate line are turned on. The data driver 150 applies the gray scale voltages corresponding to the image data signal DATA to the data lines D1 to Dm. The gray scale voltages applied to the data lines D1 to Dm are applied to the liquid crystal capacitors and the storage capacitors through the turned-on switching transistors. In this case, a period during which the switching transistors arranged in the one row are turned on, i.e., one period of the data enable signal DE, is referred to as "one horizontal period" or "1H".

Figure 2:
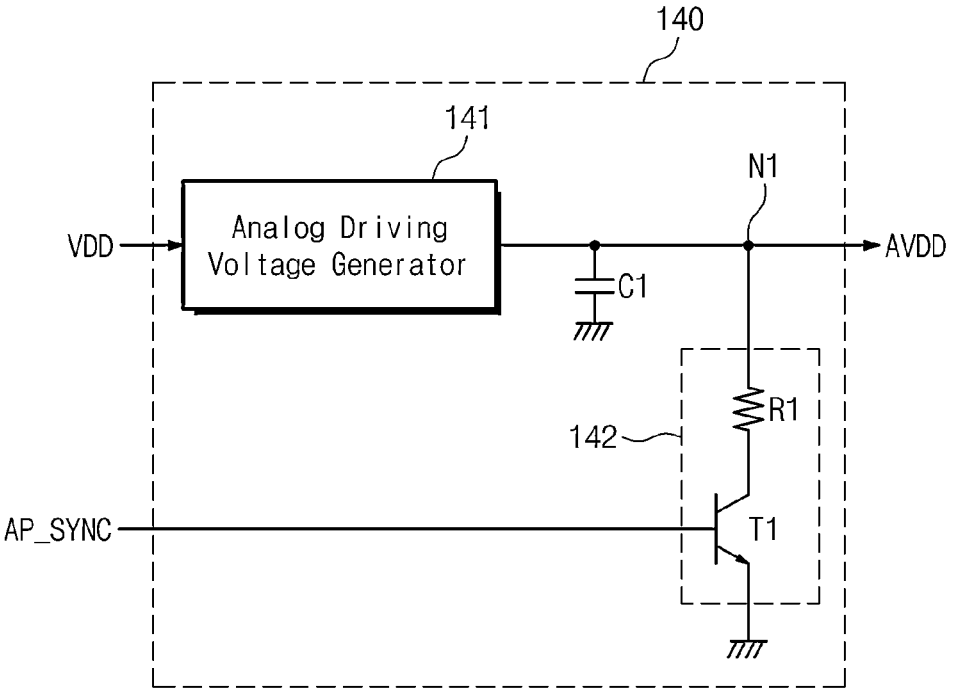
FIG. 2 illustrates a configuration of the voltage generator in FIG. 1 according to exemplary embodiments of the present invention.

FIG. 2 illustrates a configuration of a voltage generator 140 as shown in FIG. 1.

Referring to FIG. 2, the voltage generator 140 may include an analog driving voltage generator 141, a capacitor C1, and a discharge circuit 142. The analog driving voltage generator 141 may convert the source voltage VDD received from a voltage source to the analog driving voltage AVDD, and may output the analog driving voltage AVDD through an output terminal N1. The voltage source providing the source voltage VDD may, in some cases, be an external voltage source, and, in some cases, an internal voltage source.

The capacitor C1 is connected between the output terminal N1 and a ground voltage VSS. The capacitor C1 may be, but is not limited to, a multi-layer ceramic capacitor.

The discharge circuit 142 is connected between the output terminal N1 and a ground voltage VSS and may operate in response to the blank synchronization signal AP_SYNC. The discharge circuit 142 includes a resistor R1 and a transistor T1. The resistor R1 includes a first terminal connected to the output terminal N1 and a second terminal connected to the transistor T1. The transistor T1 includes a collector terminal connected to the second terminal of the resistor R1, an emitter terminal connected to the ground voltage VSS, and a base terminal connected to the black synchronization signal AP_SYNC. As an example, the transistor T1 may be a bipolar junction transistor. However, it should be understood that various suitable types of transistors including, for example, field-effect transistors (FETS), may be used as the transistor T1 in the discharge circuit 142.

Figure 3:
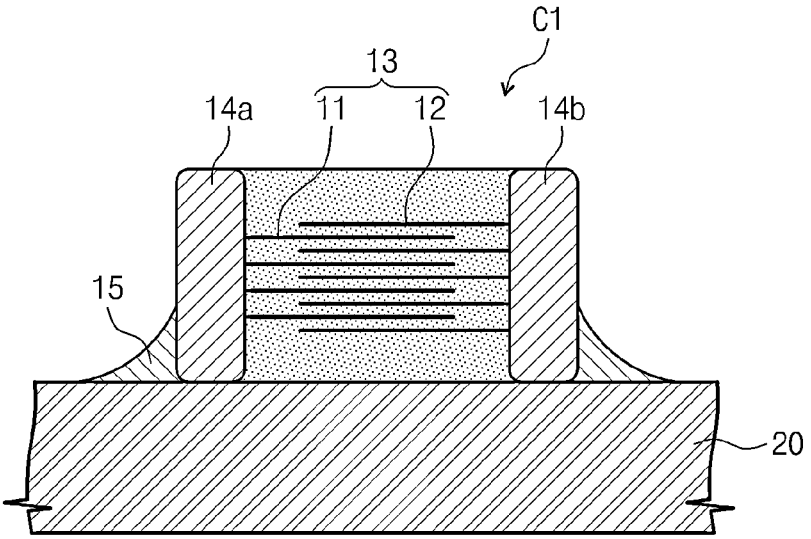
FIG. 3 is a cross-sectional view illustrating a capacitor shown in FIG. 2 mounted on a circuit board according to exemplary embodiments of the present invention.

FIG. 3 is a cross-sectional view showing the capacitor C1 shown in FIG. 2 mounted on a circuit board.

Referring to FIG. 3, the capacitor C1 may be a multi-layer ceramic capacitor C1, and may include a body 13 including alternately-stacked dielectric layers 11 and internal electrodes 12, and a pair of external electrodes 14*a* and 14*b* disposed at both sides of the body 13. External electrode 14*a* is connected to dielectric layers 11 and the external electrode 14*b* is connected to the internal electrodes 12.

The dielectric layers 11 may be formed of a ferroelectric material including barium titanate as its main component. The dielectric layers 11 may also include other ferroelectric materials.

The internal electrodes 12 may include a metal thin layer manufactured by sintering a metal paste material, e.g., Nickel (Ni), Palladium (Pd), Silver-Palladium (Ag-Pd), and Cooper (Cu). The external electrodes 14*a* and 14*b* may include a metal material, such as Cooper (Cu) and Nickel (Ni), and surfaces of the external electrodes 14*a* and 14*b* may be plated with a solder to improve solder wettability.

A circuit board 20 may include a region on which the capacitor C1 is mounted. The capacitor C1 may be mounted on the circuit board 20 and may be electrically connected to a conductive pattern (not shown) formed on the circuit board 20 using a conductive material 15, e.g., solder, coated on an upper surface of the circuit board 20. The capacitor C1 and all circuits of the voltage generator 140 may, in some cases, be mounted on the circuit board 20.

The conductive material 15 may act as a vibration medium between the capacitor C1 and the circuit board 20. A ripple periodically occurring in the analog driving voltage AVDD may cause vibration noise in the capacitor C1.

Figure 4:
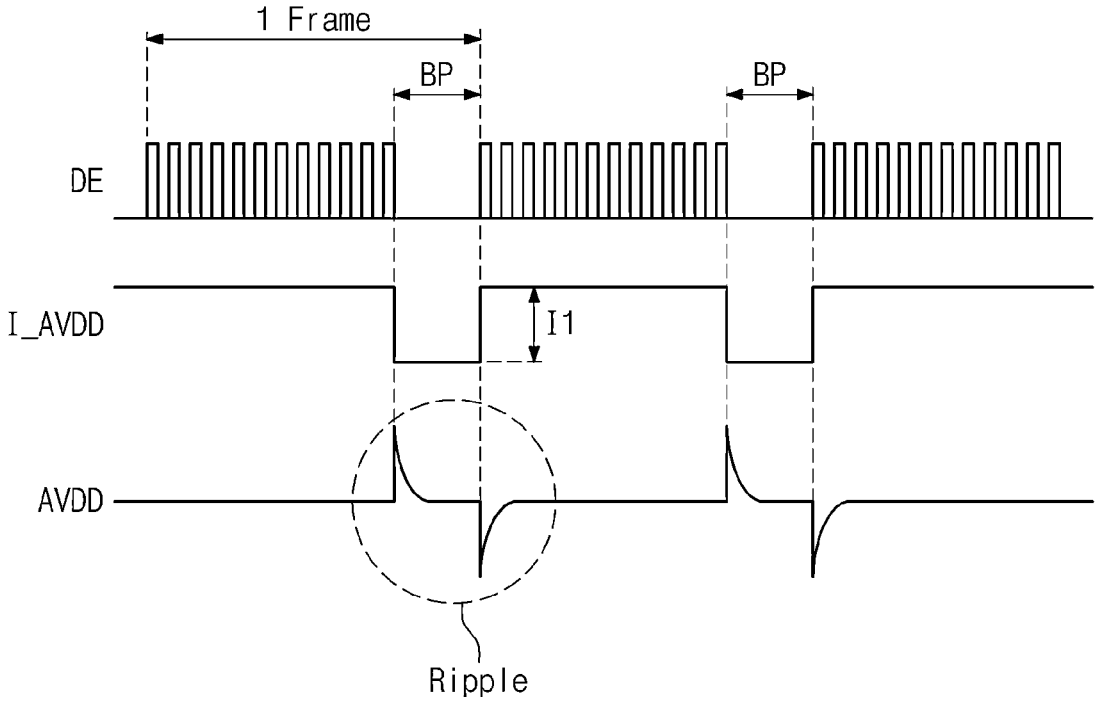
FIG. 4 is a timing diagram of an analog driving voltage generated by the voltage generator shown in FIG. 2 according to exemplary embodiments of the present invention.

FIG. 4 is a timing diagram showing the variation of the analog driving voltage generated by the voltage generator shown in FIG. 2 in accordance with an operation of the display device.

Referring to FIG. 2 and FIG. 4, an output enable signal DE applied to the data driver 150 from the timing controller 120 may include an active period during which effective image data signal DATA are applied to the display panel 110 through the data driver 150 and a blank period BP. During the active period, a current I_AVDD having a predetermined level may flow through the output terminal N1. During the blank period BP, the current consumed in the display device 100 may rapidly decrease, and consequently a ripple may occur in the analog driving voltage AVDD.

The display device 100 may include the blank period BP in every frame, and one frame may have a period of 60 Hz, 120 Hz, or 240 Hz, which are audible frequencies. The ripple occurring in the analog driving voltage AVDD output from the output terminal N1 connected to the capacitor C1 may cause the capacitor C1 to vibrate, and, as a result, vibration noise is generated. Therefore, the ripple in the analog driving voltage AVDD is required to be reduced.

Figure 5:
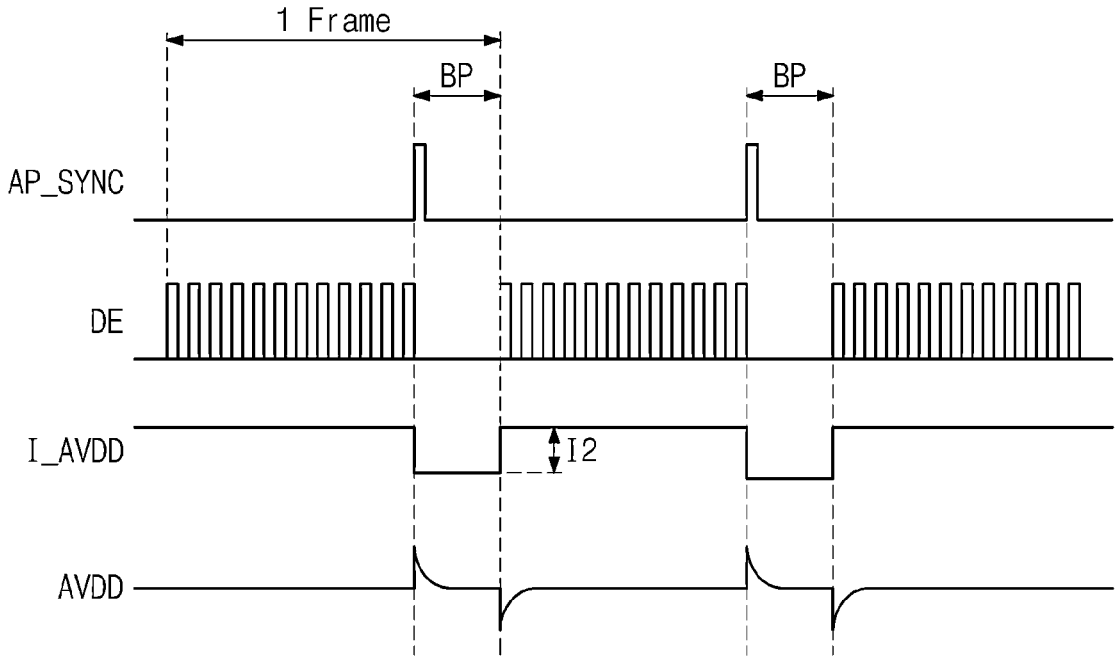
FIG. 5 is a timing diagram of an analog driving voltage generated by the voltage generator shown in FIG. 2 according to exemplary embodiments of the present invention.

FIG. 5 is a timing diagram showing the variation of the analog driving voltage generated by the voltage generator 140 shown in FIG. 2.

The timing controller 120 outputs a high voltage in the blank synchronization signal AP_SYNC to indicate a start of the blank period BP. The transistor T1 of the discharge circuit 142 shown in FIG. 2 is turned on by the blank synchronization signal AP_SYNC. Accordingly, the current flowing through the output terminal N1 may be discharged through the resistor R1 and the transistor T1.

At the start of the blank period BP, i.e., when the blank synchronization signal AP_SYNC is activated to a high level (i.e., the high voltage), the current consumption through the discharge circuit 142 increases, and thus the level of the current I_AVDD at the output terminal N1 becomes lower. A difference I2 between the current level of the active period and the current level of the blank period BP shown in FIG. 5 is smaller than a difference I1 between the current level of the active period and the current level of the blank period BP shown in FIG. 4. When the variation in the current I_AVDD is decreased, the ripple occurring in the analog driving voltage AVDD may be reduced. Therefore, the vibration of the capacitor C1 becomes small and consequently the vibration noise is reduced.

Figure 6:
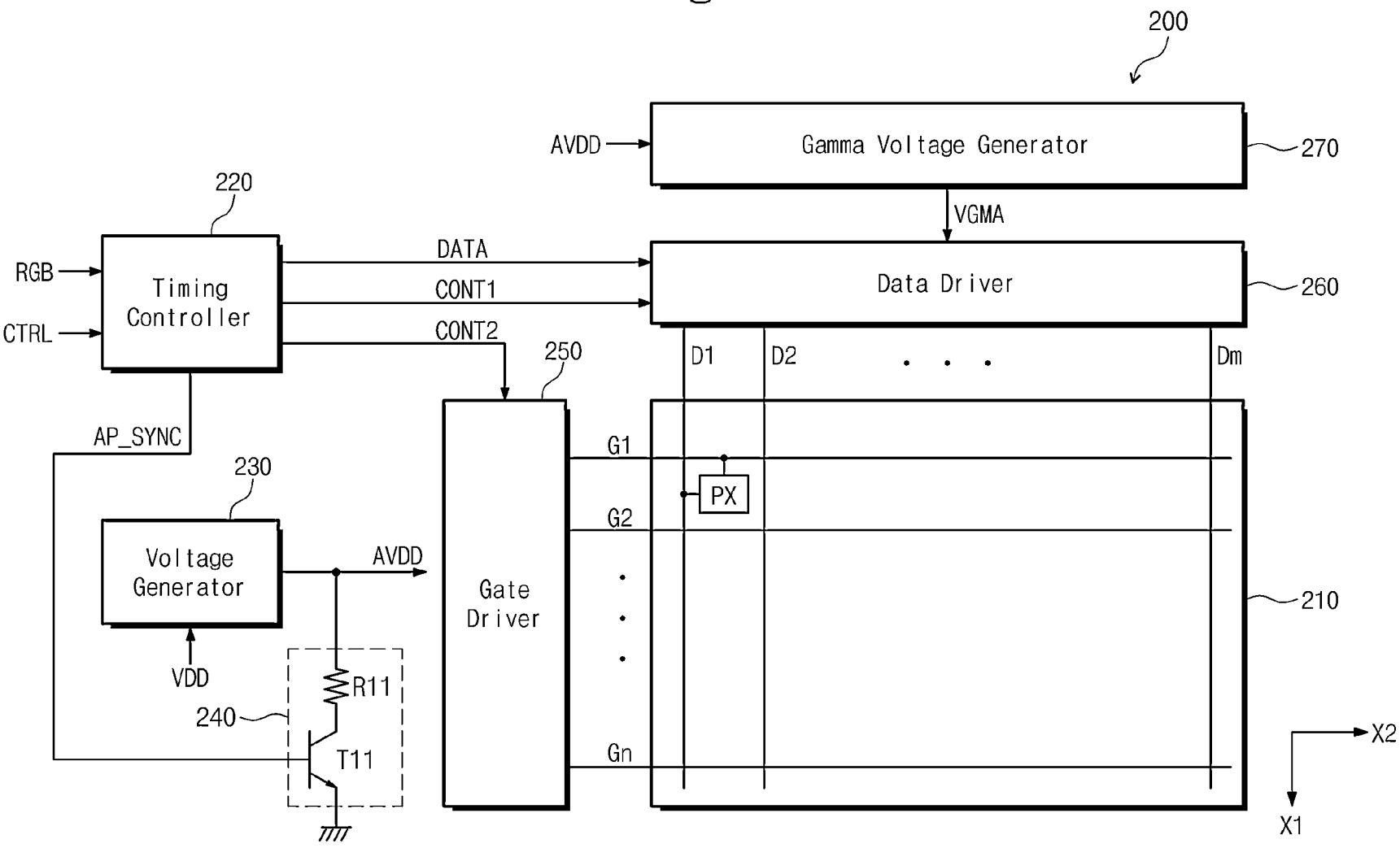
FIG. 6 is a block diagram illustrating a display device according to exemplary embodiments of the present invention.

FIG. 6 is a block diagram showing a display device according to exemplary embodiments of the present invention.

Referring to FIG. 6, a display device 200 may include a display panel 210, a timing controller 220, a voltage generator 230, a discharge circuit 240, a gate driver 250, a data driver 260, and a gamma voltage generator 270.

The display device of FIG. 6 is different from the display device 100 shown in FIG. 1, in that the discharge circuit 240 is disposed outside of the voltage generator 230 in the display device 200. The discharge circuit 240 may include a resistor R11 and a transistor T11. A first terminal of the resistor R11 is connected to the output terminal of the analog driving voltage AVDD. The transistor T11 may include a collector terminal connected to a second terminal of the resistor R11, an emitter terminal connected to the ground voltage, and a base terminal connected to the blank synchronization signal AP_SYNC. The transistor T11 may be a bipolar junction transistor, but is not limited thereto, and may be any suitable transistor. A detailed description of the display device 200 shown in FIG. 6 may be omitted for the sake of brevity as the display device 200 is similar to the display device 100 except for the implementation of the discharge circuit 240 and the voltage generator 230.

Figure 7:
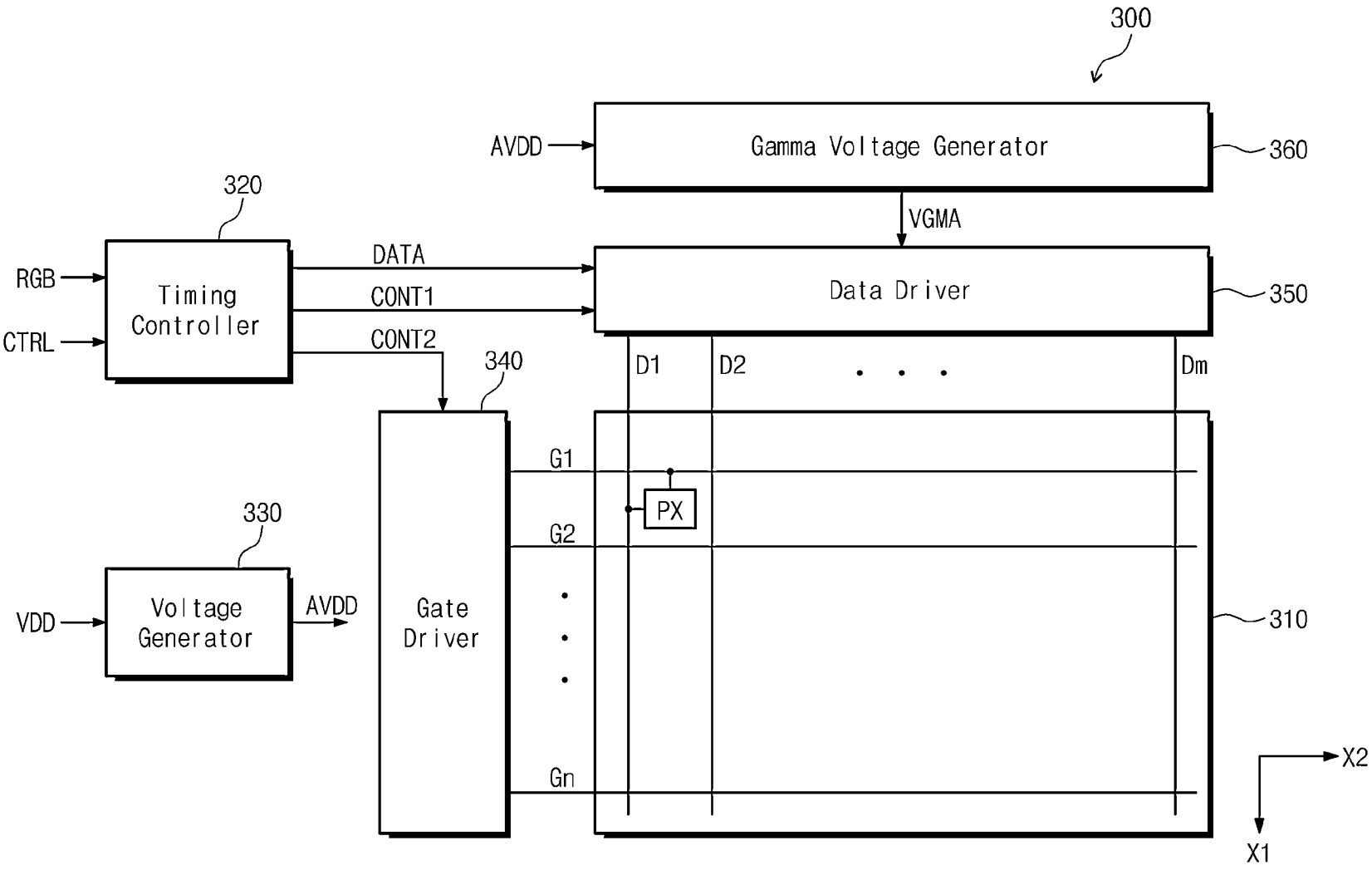
FIG. 7 is a block diagram illustrating a display device according to exemplary embodiments of the present invention.

FIG. 7 is a block diagram showing a display device according to exemplary embodiments of the present invention.

Referring to FIG. 7, a display device 300 may include a display panel 310, a timing controller 320, a voltage generator 330, a gate driver 340, a data driver 350, and a gamma voltage generator 360.

The display device 300 shown in FIG. 7 has a similar configuration as the display device 100 shown in FIG. 1. However, the voltage generator 130 of the display device 100 shown in FIG. 1 reduces the ripple in the analog driving voltage AVDD in response to the blank synchronization signal AP_SYNC from the timing controller 120, but the voltage generator 330 of the display device 300 shown in FIG. 7 does not receive the blank synchronization signal AP_SYNC. The voltage generator 330 may detect the level of the ripple in the analog driving voltage AVDD and controls the voltage level of the analog driving voltage AVDD in accordance with the detected level of the ripple.

Figure 8:
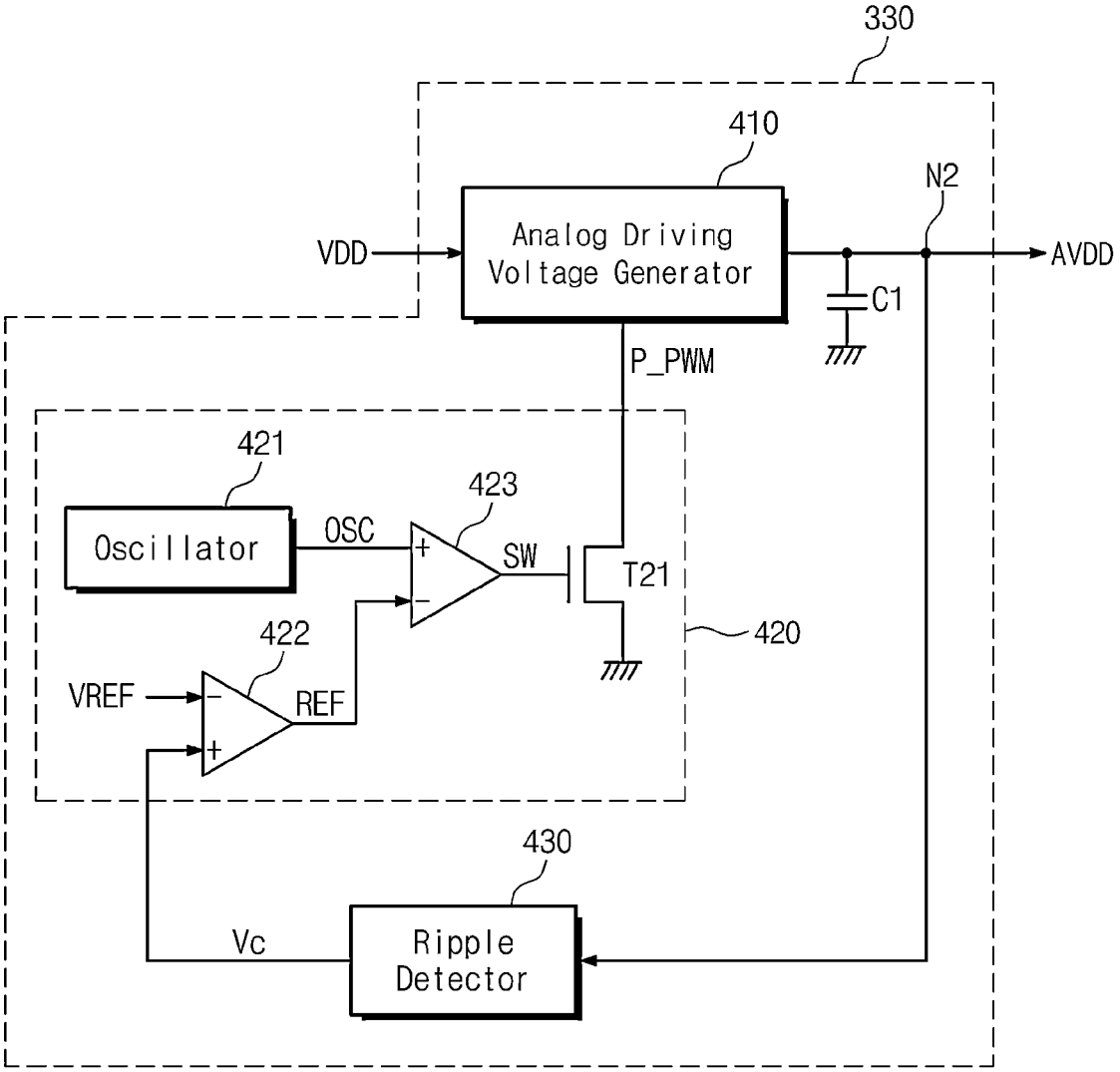
FIG. 8 is a circuit diagram illustrating the voltage generator shown in FIG. 7 according to exemplary embodiments of the present invention.

FIG. 8 is a circuit diagram illustrating the voltage generator 330 shown in FIG. 7.

Referring to FIG. 8, the voltage generator 330 may include an analog driving voltage generator 410, a pulse width modulation circuit 420, and a ripple detector 430.

The analog driving voltage generator 410 may convert a source voltage VDD from a voltage source (not shown) to an analog driving voltage AVDD in response to a pulse width modulation signal P_PWM, and may output the analog driving voltage AVDD through an output terminal N2. The voltage source may be external or, in some cases, internal.

The ripple detector 430 may receive the analog driving voltage AVDD from the output terminal N2 to detect the level of the ripple, and may output a control voltage Vc corresponding to the detected level of the ripple. For instance, the level of the control voltage Vc may be in proportion to the level of the ripple included in the analog driving voltage AVDD.

The pulse width modulation circuit 420 may output the pulse width modulation signal P_PWM corresponding to the control voltage Vc from the ripple detector 430. The pulse width modulation circuit 420 may include an oscillator 421, comparators 422 and 423, and a transistor T21.

The oscillator 421 may generate a reference oscillation signal OSC, which has a predetermined frequency, in a saw tooth wave form or any other suitable wave form.

The comparator 422 may compare a reference voltage VREF and the control voltage Vc from the ripple detector 430, and may output a reference signal REF corresponding to a difference between the reference voltage VREF and the control voltage Vc. The reference voltage VREF may be generated by a voltage generator, e.g., a band gap reference generator. The comparator 422 may output the reference signal REF when the control voltage Vc is increased to a level higher than that of the reference voltage VREF.

The comparator 423 may compare the reference oscillation signal OSC from the oscillator 421 and the reference signal REF, and may output a switching signal SW corresponding to a difference between the reference oscillation signal OSC and the reference signal REF. For instance, when the reference oscillation signal OSC has a voltage level higher than a voltage level of the reference signal REF, the comparator 423 outputs the switching signal SW at a first level, e.g., a high level. In some cases, the comparator 423 outputs the switching signal SW at a second level, e.g., a low level, when the reference oscillation signal OSC has a voltage level lower than a voltage level of the reference signal REF.

The transistor T21 may be connected to the analog driving voltage generator 410 and the ground voltage VSS, and may include a gate terminal controlled by the switching signal SW from the comparator 423. When the switching signal SW has the first level, the transistor T21 is turned on, and thus the pulse width modulation signal P-PWM has a low level. On the other hand, when the switching signal SW has the second level, the transistor T21 is turned off, so that the pulse width modulation signal P_PWM has a high level.

Figure 9:
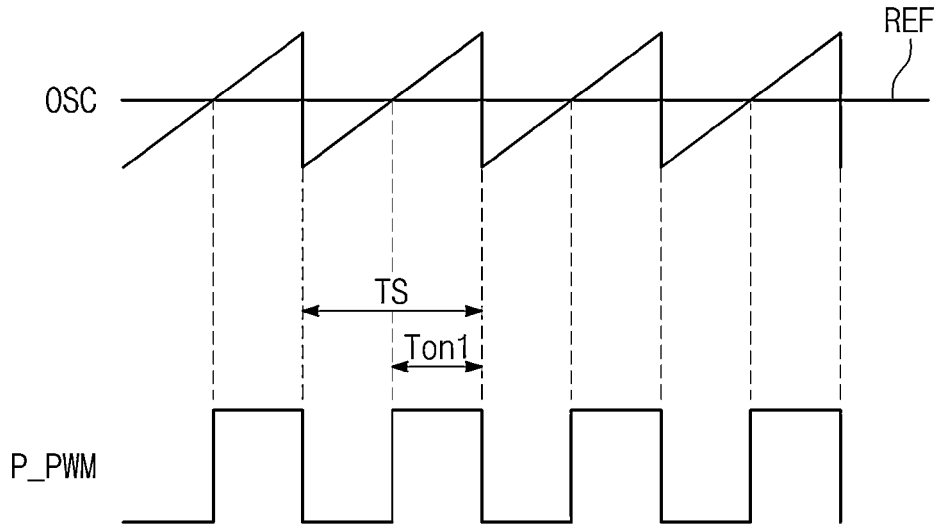
FIG. 9 and FIG. 10 are timing diagrams illustrating a pulse width modulation signal in accordance with whether a ripple occurs in an analog driving voltage according to exemplary embodiments of the present invention.
Figure 10:
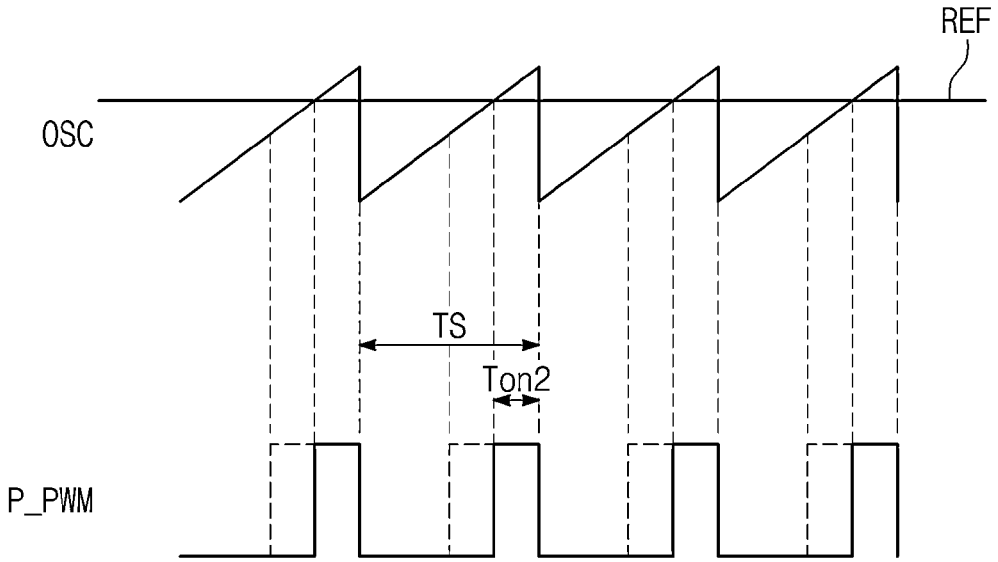

FIG. 9 and FIG. 10 are timing diagrams showing a variation of a pulse width modulation signal in accordance with whether a ripple occurs in an analog driving voltage.

Referring to FIG. 9 and FIG. 10, the voltage level of the reference signal REF may determine a pulse width of the high level of the pulse width modulation signal P_PWM within one period TS of the reference oscillation signal OSC. When the ripple occurs in the analog driving voltage AVDD, the voltage level of the reference signal REF may increase more than when the ripple does not occur in the analog driving voltage AVDD. Therefore, when the ripple occurs in the analog driving voltage AVDD, the pulse width of the high level of the pulse width modulation signal P_PWM is shortened (Ton1>Ton2).

Since the analog driving voltage generator 410 generates the analog driving voltage AVDD in response to the pulse width modulation signal P_PWM, the analog driving voltage generator 410 may reduce the voltage level of the analog driving voltage AVDD when the pulse width of the pulse width modulation signal P_PWM is shortened. For instance, if the voltage level of the analog driving voltage AVDD is about 17.5 volts in a normal mode, the voltage level of the analog driving voltage AVDD may be reduced to about 15 volts when the ripple occurs in the analog driving voltage AVDD.

When the voltage level of the analog driving voltage AVDD is decreased, the level of the ripple may also decrease due to the decrease of the voltage level of the analog driving voltage AVDD. Thus, the vibration of the capacitor C1 is reduced, and the vibration noise may be minimized.

Figure 11:
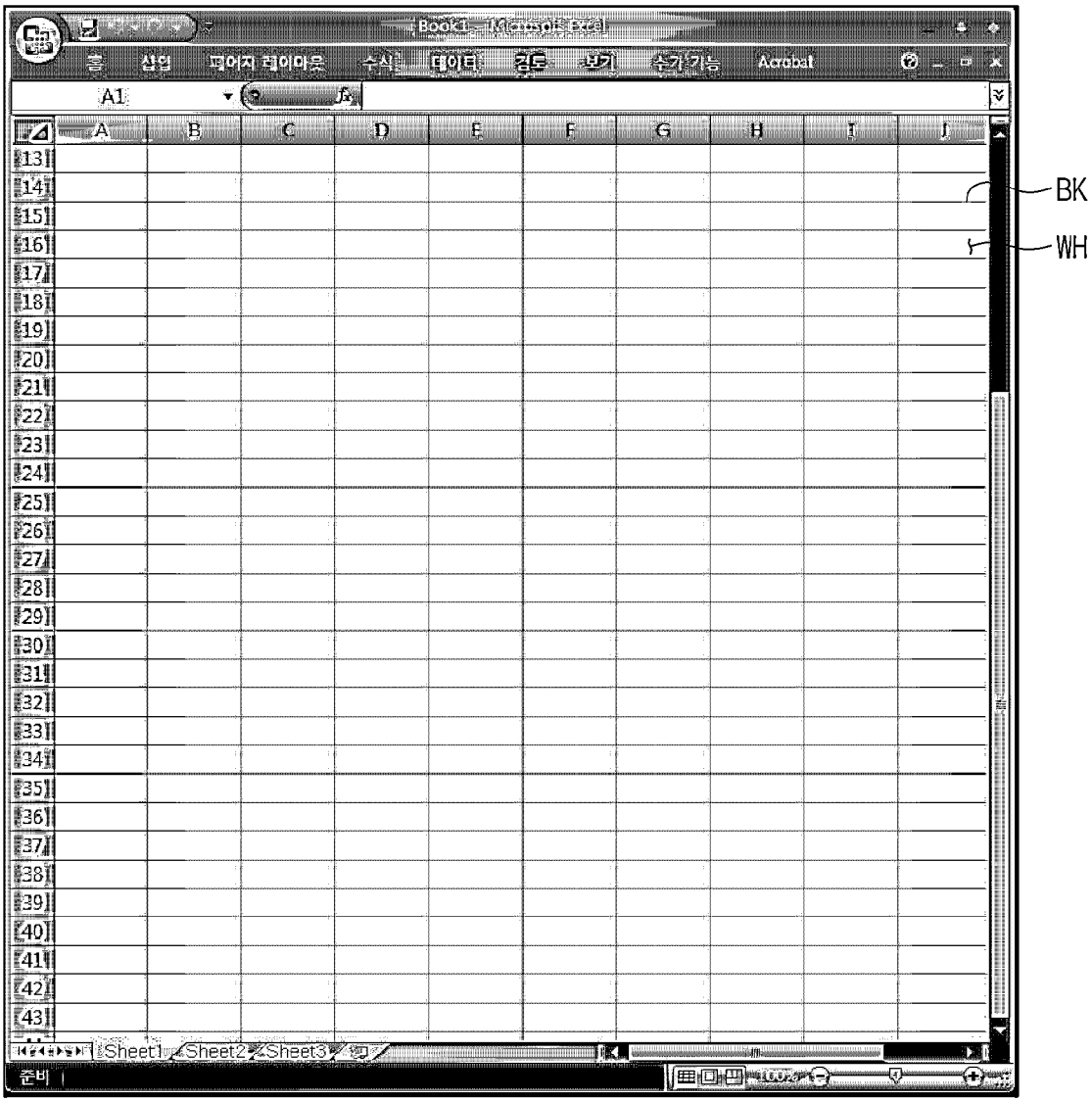
FIG. 11 is a view illustrating an image displayed on a display device according to exemplary embodiments of the present invention.

FIG. 11 is a view showing an image displayed on a display device.

Referring to FIG. 11, a black image BK and a white image WH are alternately displayed on the display panel at predetermined intervals according to a specific application program. In this case, since the black image BK and the white image WH are alternately displayed at the predetermined intervals, the ripple occurs in the analog driving voltage AVDD. This is because an amount of the current variation consumed in the display device when the black image BK is displayed on the display panel is different from that when the white image WH is displayed on the display panel.

Figure 12:
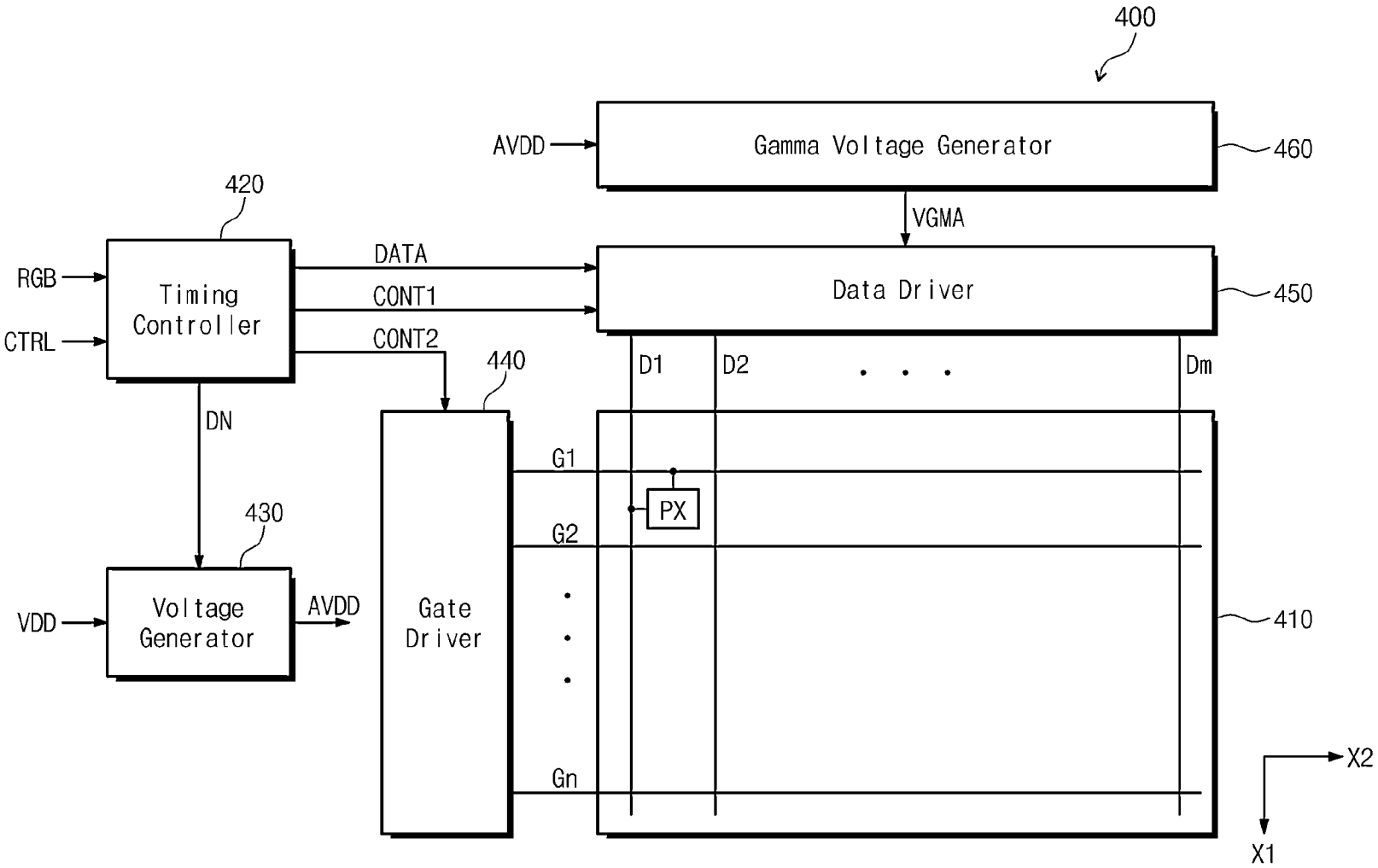
FIG. 12 is a block diagram illustrating a display device according to exemplary embodiments of the present invention.

FIG. 12 is a block diagram showing a display device according to exemplary embodiments of the present invention.

The display device 400 shown in FIG. 12 has a similar configuration to the display device 100 shown in FIG. 1. The timing controller 120 of the display device 100 applies the blank synchronization signal AP_SYNC to the voltage generator 130, but the display device shown in FIG. 12 applies a voltage drop signal DN to a voltage generator 430.

A timing controller 420 allows the voltage drop signal DN to be activated to a first level when an image signal RGB from an external source has a predetermined level. When a level of the image signals RGB is varied at every predetermined interval within one frame, the timing controller 420 may activate the voltage drop signal DN to the first level.

The voltage generator 430 may generate the analog driving voltage AVDD at a normal level, e.g., about 17.5 volts, when the voltage drop signal DN generated by the timing controller 420 has the second level. When the voltage drop signal DN generated by the timing controller 420 is activated to the first level, the voltage generator 430 may generate the analog driving voltage AVDD at a voltage level, e.g., about 15 volts, lower than the normal level.

Since the level of the ripple is lowered when the voltage level of the analog driving voltage AVDD is decreased, the vibration of the multi-layer ceramic capacitor connected to the output terminal of the voltage generator 430 is reduced, thereby minimizing the vibration noise.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A voltage generator, comprising:

an analog driving voltage generator configured to convert a source voltage to an analog driving voltage and to output the analog driving voltage via an output terminal;

a capacitor connected between the output terminal and a ground voltage; and a discharge circuit connected between the output terminal and the ground voltage and configured to discharge a current at the output terminal in response to a blank synchronization signal, wherein the discharge circuit comprises:

a resistor comprising a first terminal and a second terminal, the first terminal connected to the output terminal; and a switching device configured to be controlled by the blank synchronization signal and to provide a current path between the second terminal and the ground voltage.

2. The voltage generator of claim 1, wherein the switching device comprises a transistor comprising a collector terminal connected to the second terminal of the resistor, an emitter terminal connected to the ground voltage, and a base terminal configured to receive the blank synchronization signal.

3. The voltage generator of claim 1, wherein the capacitor comprises a multi-layer capacitor.

4. A display device, comprising:

a display panel comprising a plurality of pixels;

a driving circuit configured to control the display panel to display an image and to provide a blank synchronization signal; and a voltage generator configured to provide an analog driving voltage to drive the driving circuit, the voltage generator comprising:

an analog driving voltage generator configured to convert a source voltage to an analog driving voltage and to output the analog driving voltage via an output terminal;

a capacitor connected between the output terminal and a ground voltage; and a discharge circuit connected between the output terminal and the ground voltage and configured to discharge a current at the output terminal in response to the blank synchronization signal, wherein the discharge circuit comprises:

a resistor comprising a first terminal and a second terminal, the first terminal connected to the output terminal; and a switching device configured to be controlled by the blank synchronization signal and to provide a current path between the second terminal and the ground voltage.

5. The display device of claim 4, wherein the pixels are connected to a plurality of gate lines and a plurality of data lines crossing the gate lines, and the driving circuit comprises:

a data driver configured to drive the data lines;

a gate driver configured to drive the gate lines; and a timing controller configured to provide an image data signal and a first control signal to the data driver and a second control signal to the gate driver in response to an image signal and control signals from an external source, and to provide the blank synchronization signal.

6. The display device of claim 5, wherein a start of the blank synchronization signal corresponds to a start of a blank period in the image data signal applied to the data driver.

7. The display device of claim 4, wherein the switching device comprises a transistor comprising a collector terminal connected to the second terminal of the resistor, an emitter terminal connected to the ground voltage, and a base terminal configured to receive the blank synchronization signal.

8. The display device of claim 4, wherein the capacitor comprises a multi-layer capacitor.

9. A voltage generator, comprising:

an analog driving voltage generator configured to convert a source voltage to an analog driving voltage and to output the analog driving voltage via an output terminal;

a capacitor connected between the output terminal and a ground voltage;

a ripple detector configured to receive the analog driving voltage output from the output terminal to detect a level of a ripple and to output a control voltage corresponding to the level of the ripple; and a pulse width modulation circuit configured to output a pulse width modulation signal having a pulse width corresponding to the control voltage, wherein the analog driving voltage output from the analog driving voltage generator comprises a voltage level correspond to the pulse width modulation signal.

10. The voltage generator of claim 9, wherein the pulse width modulation circuit comprises:

an oscillator configured to provide a reference oscillation signal;

a first comparator configured to provide a reference signal corresponding to a difference between a reference voltage and the control voltage;

a second comparator configured to provide a switching signal corresponding to a difference between the reference oscillation signal and the reference signal; and a switch configured to provide the pulse width modulation signal in response to the switching signal.

11. The voltage generator of claim 10, wherein the switch comprises a gate terminal configured to be controlled by the switching signal and the switch is configured to provide a current path between the analog driving voltage generator and a ground voltage.

12. A display device, comprising:

a display panel comprising a plurality of pixels;

a driving circuit configured to control the display panel to display an image; and a voltage generator configured to provide an analog driving voltage to drive the driving circuit, the voltage generator comprising:

an analog driving voltage generator configured to convert a source voltage to the analog driving voltage and to output the analog driving voltage through an output terminal;

a capacitor connected between the output terminal and a ground voltage;

a ripple detector configured to receive the analog driving voltage from the output terminal to detect a level of a ripple and to output a control voltage corresponding to the level of the ripple; and a pulse width modulation circuit configured to output a pulse width modulation signal having a pulse width corresponding to the control voltage, wherein the analog driving voltage output from the analog driving voltage generator comprises a voltage level corresponding to the pulse width modulation signal.

13. The display device of claim 12, wherein the pixels are connected to a plurality of gate lines and a plurality of data lines to cross the gate lines, and the driving circuit comprises:

a data driver configured to drive the data lines;

a gate driver configured to drive the gate lines; and a timing controller configured to provide an image data signal and a first control signal to the data driver and a second control signal to the gate driver in response to an image signal and control signals from an external source.

14. The display device of claim 12, wherein the pulse width modulation circuit comprises:

an oscillator configured to provide a reference oscillation signal;

a first comparator configured to provide a reference signal corresponding to a difference between a reference voltage and the control voltage;

a second comparator configured to provide a switching signal corresponding to a difference between the reference oscillation signal and the reference signal; and a switch configured to provide the pulse width modulation signal in response to the switching signal.

15. The display device of claim 14, wherein the switch comprises a gate terminal configured to be controlled by the switching signal and the switch is configured to provide a current path between the analog driving voltage generator and the ground voltage.

16. A method to reduce noise in a display device, the method comprising:

converting a source voltage to an analog driving voltage;

charging a capacitor with the analog driving voltage;

detecting a level of a ripple in the analog driving voltage to provide a control voltage corresponding to the level of the ripple; and generating a pulse width modulation signal corresponding to the control voltage, wherein the analog driving voltage comprises a voltage level corresponding to a voltage level of the pulse width modulation signal.

17. The method of claim 16, wherein providing the pulse width modulation circuit comprises:

generating a reference oscillation signal;

generating a reference signal corresponding to a difference between a reference voltage and the control voltage;

generating a switching signal corresponding to a difference between the reference oscillation signal and the reference signal; and generating the pulse width modulation signal according to a level of the switching signal.

18. The method of claim 17, further comprising opening or closing a current path according to the level of the switching signal.

* * * * *